US005920132A

United States Patent [19]

Rockfield, Jr. et al.

[11] Patent Number: 5,920,132

[45] Date of Patent: Jul. 6, 1999

[54] NON-ROTATING PORTABLE VOLTAGE SAG GENERATOR

[75] Inventors: Martin L. Rockfield, Jr., Pleasanton; Tejindar P. Singh, Danville; Siddharth C. Bhatt, San Jose, all of Calif.

[73] Assignee: Electric Power Research Institute, Palo Alto, Calif.

[21] Appl. No.: 08/938,462

[22] Filed: Sep. 29, 1997

[51] Int. Cl.[6] ..... H01H 35/00

[52] U.S. Cl. ..... 307/130; 307/83; 323/220; 327/261

[58] Field of Search ..... 307/130, 83, 17; 324/102; 323/220; 327/261

[56] References Cited

U.S. PATENT DOCUMENTS

| | | | |
|---|---|---|---|
| 3,569,829 | 3/1971 | Griffey | 324/72 |
| 3,579,086 | 5/1971 | Lebenbaum, Jr. | 363/161 |
| 3,626,248 | 12/1971 | Bartlett et al. | 361/1 |
| 3,967,181 | 6/1976 | Chambers et al. | 363/23 |
| 4,131,938 | 12/1978 | Milberger et al. | 363/101 |
| 4,673,825 | 6/1987 | Raddi et al. | 307/66 |
| 5,602,462 | 2/1997 | Stich et al. | 323/258 |

OTHER PUBLICATIONS

Collins, Jr., Morgan, "A Three–Phase Sag Generator For Testing Industrial Equipment", IEEE Transactions on Power Delivery, pp. 526–532, Jan. 1996.

*Primary Examiner*—Richard T. Elms
*Assistant Examiner*—Peter Zura
*Attorney, Agent, or Firm*—Jerry G. Wright; Flehr Hohbach Test Albritton and Herbert LLP

[57] ABSTRACT

A non-rotating portable voltage sag generator includes for each phase a pair of cascaded standard industrial auto-transformers each having, for example, six taps and when they are cascaded the final output voltage of each phase is a product of the per unit value of each individual auto-transformer. Closed transition switching is provided to switch the auto-transformer into and out of the circuit effectively only during the time a voltage sag is desired. All of the switches and auto-transformers are conveniently carried in a single portable enclosure. There are no moving parts or diesel engines; thus, the non-rotating sag generator is useable in any part of an industrial plant.

7 Claims, 7 Drawing Sheets

NON-ROTATING PORTABLE VOLTAGE SAG GENERATOR

The present invention is directed to a non-rotating portable voltage sag generator, and more specifically a sag generator for connection between a utility type electric power source and an industrial load which may have complicated electronic processing equipment.

BACKGROUND OF THE INVENTION

Voltage sags caused by either utility or customer side events cause industrial plant process control equipment to malfunction. Such voltage sags are classified as the momentary reduction in voltage for a period of 0.5 to 30 electrical cycles. These sags often accompany weather related events such as lightning, wind, and ice, that impact utility power circuits. They can also occur within the plant from electrical equipment failure. As protective devices clear these faults, voltage on adjacent circuits return to normal but not soon enough for nearby equipment to be unaffected. Control and logic circuits sense the voltage disturbances and often stop the flow of production. One type of industrial process, for example might be a sheet glass production plant. Modern industrial equipment which uses expensive electronic equipment is especially sensitive to voltage disturbances.

It is, of course, desirable that the process equipment "ride-through" these voltage disturbances. Process components may be the-modified to improve ride-through and desensing modifications such as constant voltage transformers can be installed where necessary. In any case, an effective voltage sag generator is necessary to initiate voltage sags in order to determine equivalent sensitivity to voltage disturbances and to bench mark desensing modifications as described above.

One type of sag generator used in an industrial context is described in the IEEE Transactions on Power Delivery, Vol. 11, No. 1, January 1996, Pages 526–532, entitled "A Three-Phase Sag Generator for Testing Industrial Equipment". Although the sag generator was mobile, it consisted of a diesel powered synchronous generator with about 15 kilowatts capacity. The use of a diesel type engine severely limits the use of this device because of pollution and the power rating is an order of magnitude less than desired for modern industrial applications. Solid state sag generators with variacs have been used but only for small loads.

OBJECT AND SUMMARY OF INVENTION

It is an object of the present invention to provide a non-rotating portable voltage sag generator.

In accordance with the above object there is provided a non-rotating portable voltage sag generator for connection between a utility type electric power source and an industrial load comprising for each phase a pair of cascaded auto-transformers, each having a plurality of voltage taps , one of the voltage taps of a first auto-transformer being connected to the second auto-transformer and including two bipolar switches, a first for connecting in a closed condition, the power source directly to the load and in open condition diverting the power source through said first auto-transformer, and the second switch in a closed connection connecting the second auto-transformer to the load. Means are provided for connecting one of said auto-transformers to a common or neutral. Timing means initiate the voltage sag for a predetermined time interval by actuating the switches, the first switch being opened and the second switch being closed at substantially the same time. The timing means terminates the sag voltage by closing the first switch and opening the second switch at substantially the same time. Means are provided for selecting the tap of the first transformer which is connected to the second transformer and also the tap of the second transformer which is connected to the load by the second switch, the product of the per unit of voltage of each auto-transformer being the final output sag voltage to the load.

DETAILED DESCRIPTION OF PREFERRED EMBODIMENT

Figure 1:
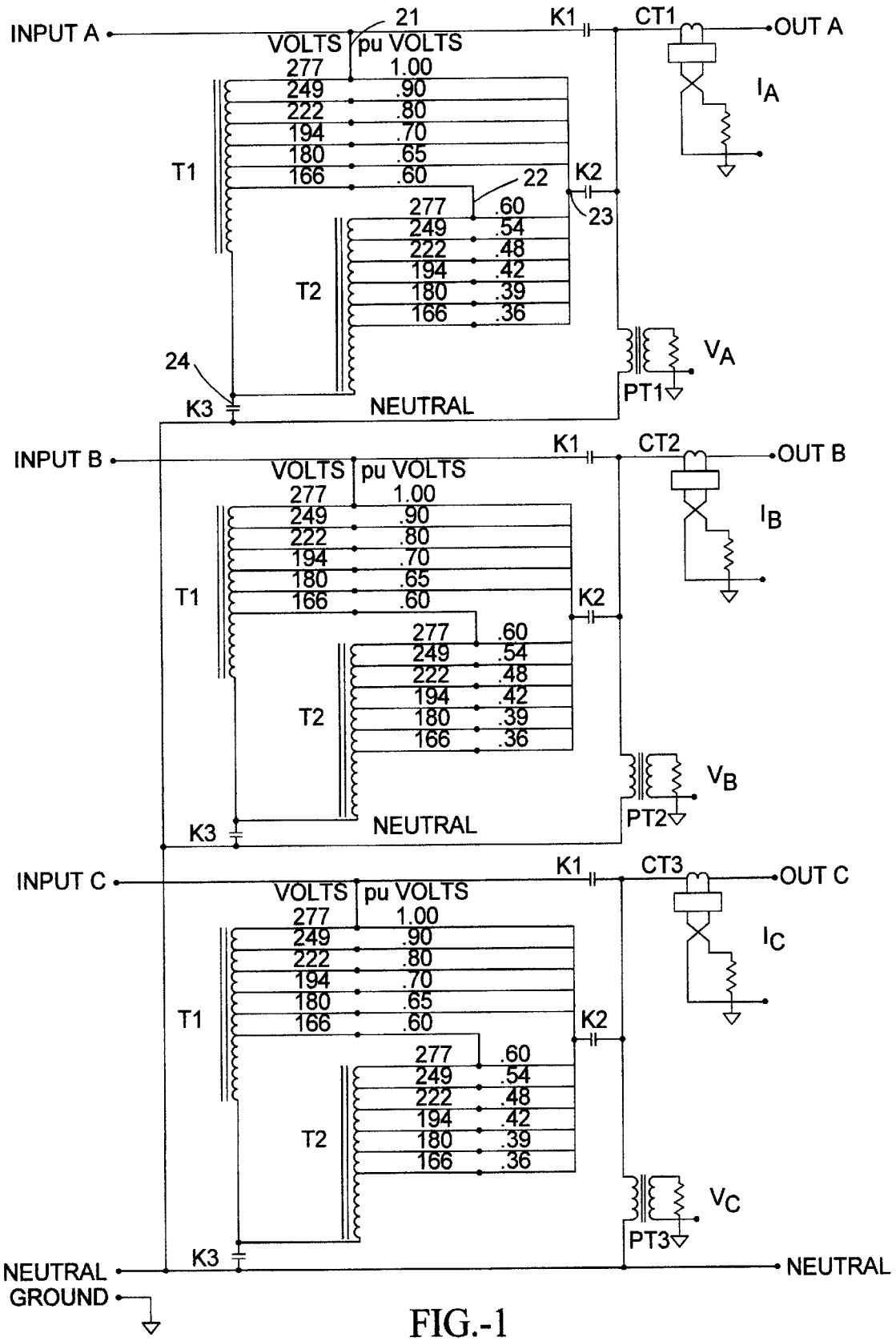
FIG. 1 is a circuit diagram of the sag generator of the present invention.

FIG. 1 is the overall circuit schematic of the voltage sag generator which has its inputs of the three-phases A, B, C from the electric utility and as its output A,B, and C phase lines to the industrial load. For each phase, there is a pair of cascaded auto-transformers T1 and T2 each of which has the six voltage taps, namely, 277, 249, 222, 194, 180, and 166 volts. And the neutral end of each auto-transformer is available. To monitor the current and voltage of each phase, that is, $I_A$, $V_A$, etc. there are current transformers CT1, CT2, CT3 and potential transformers PT1, PT2 and PT3. Finally to connect the cascaded auto-transformers between the industrial load and the utility source lines (i.e. diverting the power source through the auto-transformers) are three switches K1, K2 and K3. Thus K1, which is normally closed, is opened and then the switches K2 and K3 closed. The timing of these switches, of course, determine the length of the sag. The depth of the sag is determined by the specific tap connections on the transformers T1 and T2. These may be the same for each phase or different.

For the transformer connections shown in FIG. 1, the attached Table I (at the end of this specification) gives the per unit (pu) volts. Thus for the first of the cascaded auto-transformers T1, a connection 21 from the line input A to the 277 volt tap is rated at 1.00 pu volts and then the connection 22 shown, that is the tie as illustrated in Table I, between the 166 volt level of T1 which is 0.60 pu, means that since it is tied into the first tap or the nominal 277 volt level of the T2 transformer, the output voltage through K2 would be, in this case, 0.60 pu volts. Thus the per unit sag voltage at 23 or switch K2, which is connected to a tap of T2, is the product of the T1 and T2 pu voltages. Once the nominal source voltage is measured with a volt meter, the nominal sag voltage is $V_{sag}=V_{source}\times v_{puT1}\times V_{puT2}$.

In summary the physical transformer connections provide the depth or magnitude of the voltage sag whose amount is determined by application of the above formula. The actual physical connections are the first wire 21 to the chosen voltage tap on transformer T1, the second wire 22 from the first of the cascaded transformers T1 to T2 (this is shown by Table I) to a tap on T2. As will be discussed later, this can be done in many different modes in order to increase the range and variety of voltages. Lastly, the connection at 24, to the neutral by switch K3 is made.

Figure 2:
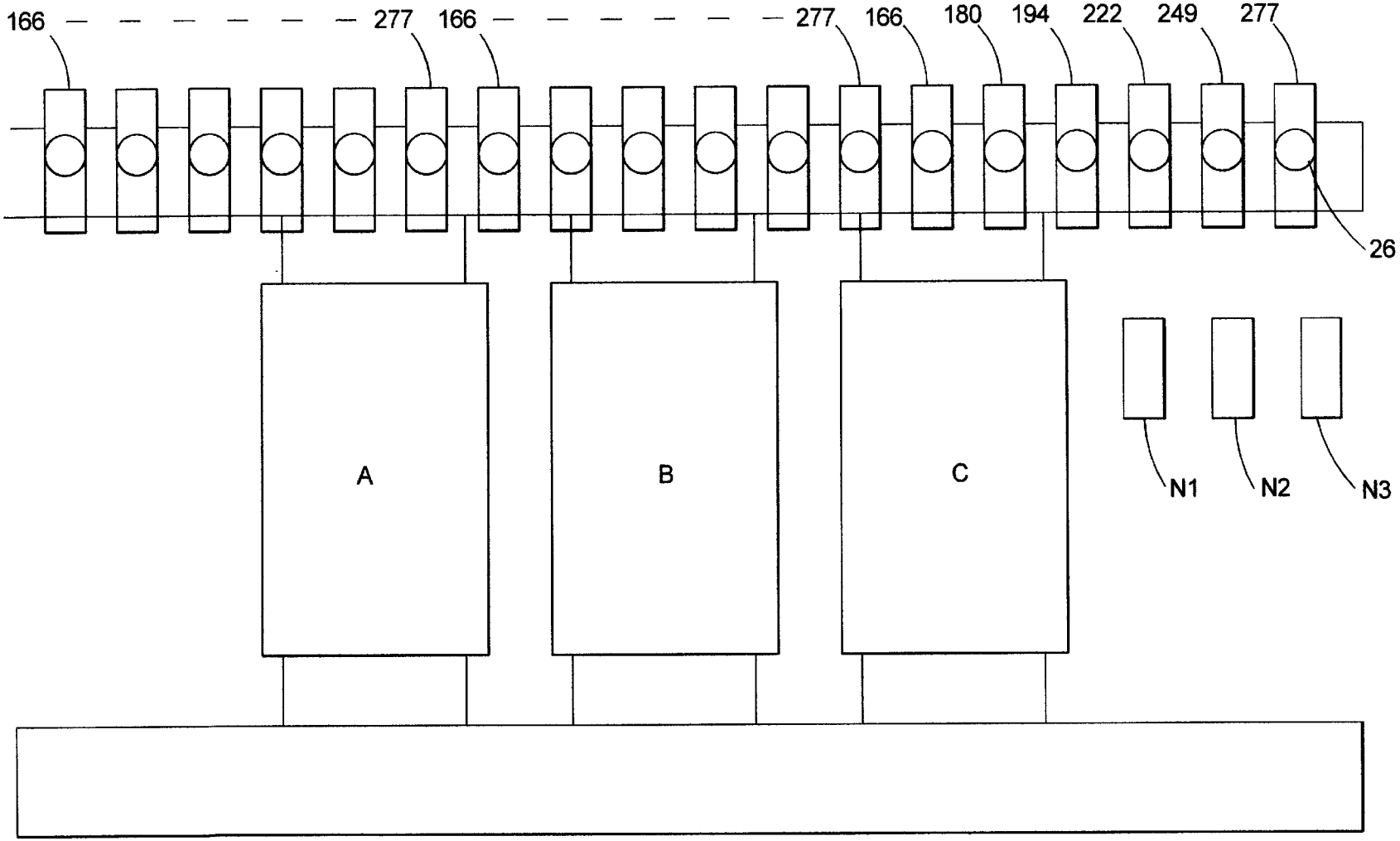
FIG. 2 is a simplified elevational view of one of the three phase transformers of FIG. 1.

FIGS. 4A through 4D more aptly illustrate the various connections and their permutations. All of these wiring connections are at the present time done manually with nuts and/or physical fasteners. This is illustrated in FIG. 2 which shows a typical T1 auto-transformer (unconnected) where the three phases are designated A, B and C. At the top of the transformer there are fixed taps for each phase designated with their nominal voltage and for each tap, there is a fastener such as a nut and bolt 26. And then there are separate neutral connections N1, N2 and N3 available. And the same is true of the transformer T2. The separate N1, N2 and N3 for each of the three windings not only enables closed transition switching (which will be discussed in conjunction with the timing logic of FIGS. 6 and 7) but also enables the operator to reverse the connection of the 277 volt and N terminals greatly increasing the range of voltage sag connections. This is illustrated in Table I; for example, in the second set of per unit voltages with the wiring reversed very low per unit voltages such as 0.06, 0.12, and 0.18 are obtainable. As discussed above 1.00 pu (per unit) volts is equal in the present context to 277 volts. Moreover, all of the foregoing is done with standard off the shelf auto-transformers. For example, the unit shown in FIG. 2 is available from Teledyne Crittenden of Los Angeles, Calif. The load power rating of this standard transformer has a continuous load rating of 100 amps at 277 volts for each winding. For momentary sag operation (which is the only time they are in the circuit) their rating may be increased three or four times in accordance with standard electrical theory. Thus a very large power consuming control process may be tested by this improved sag generator. Beside being non-rotating it is very robust even with severe loads such as induction motors.

Figure 3:
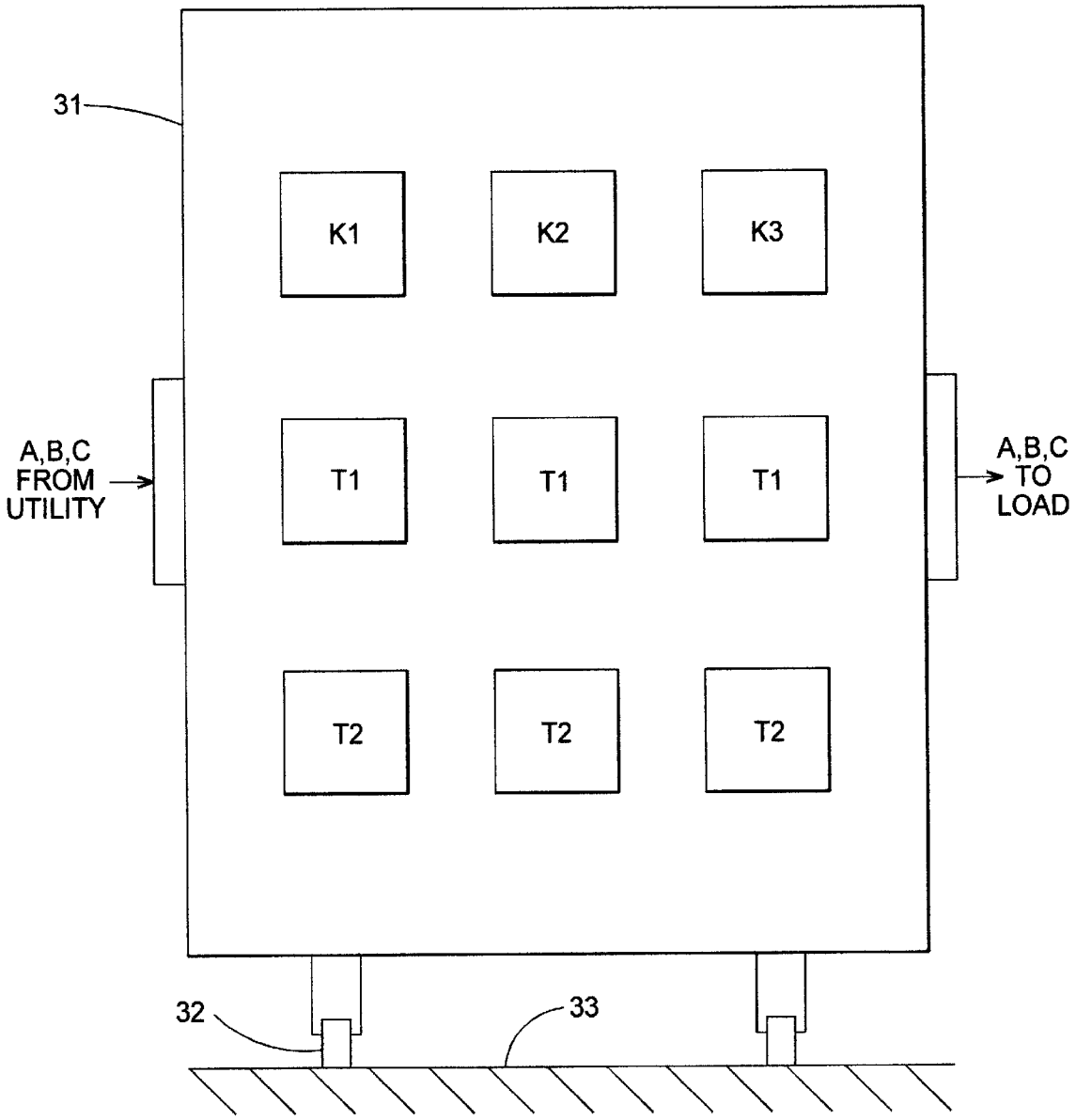
FIG. 3 is a elevational view of a portable cabinet containing the sag generator of the present invention.
Figures 5A, 5B, 5C:
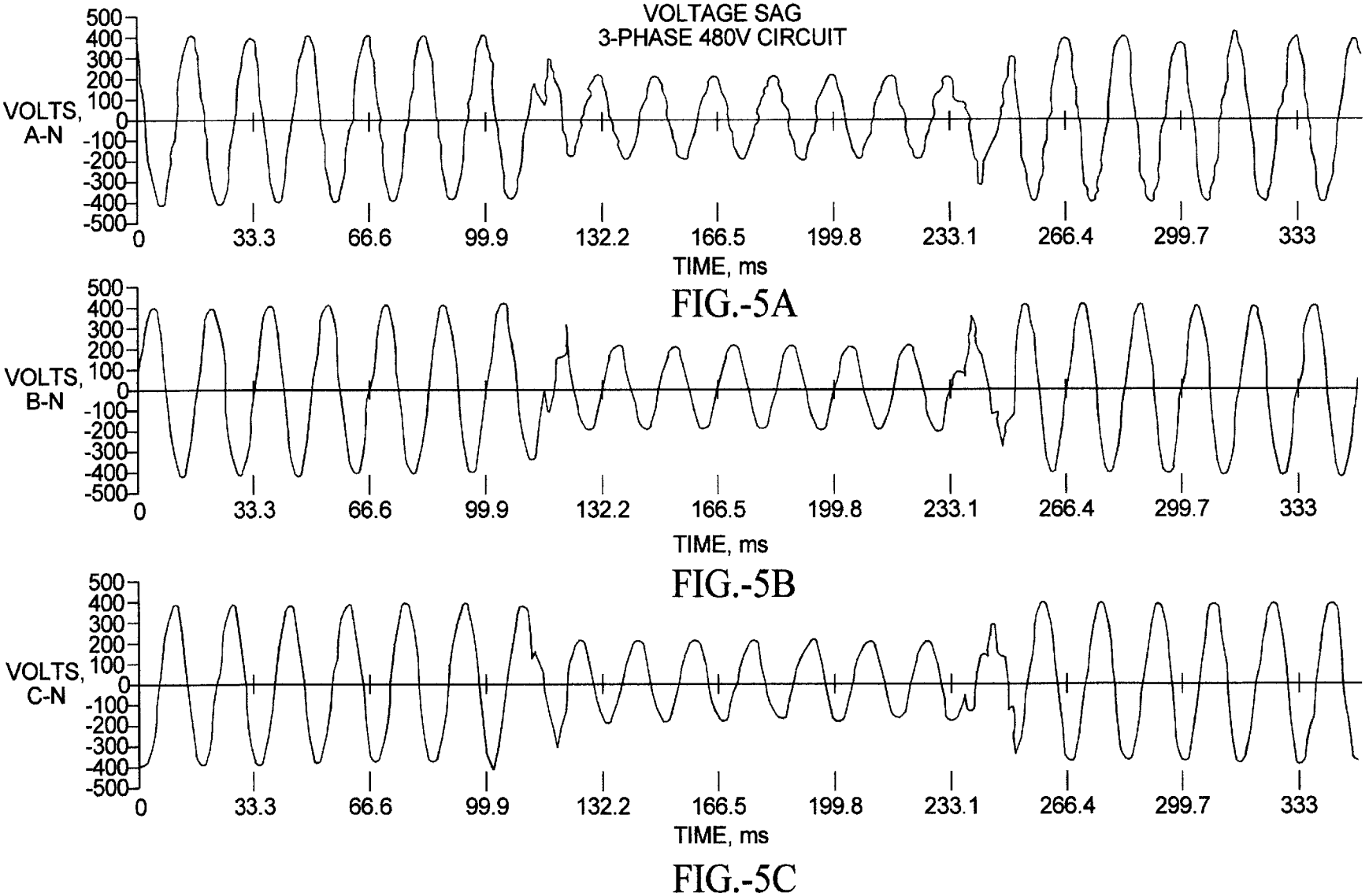
FIGS. 5A, 5B, 5C are waveforms of a typical voltage sag.

FIG. 3 illustrates the mobility of the sag generator which is contained in a portable cabinet 31, on wheels 32, which may be placed in the interior on a factory floor 33. The three phase wires A, B, C, from the utility are connected to the cabinet and then the output connected to the industrial load. In the cabinet are all the transformers T1 and T2 for each phase and also the K1, K2 and K3 switches. As will be discussed below there are also timing circuits. The bipolar switches K1, K2, and K3 or AC power contactors are available from Electrical and Electronic Controls of Hawthorne, N.Y. with the K1 and K2 switches being of the LS247 type and the K3 switch being of a LS177 type. A typical voltage sag provided by the present invention is illustrated by FIGS. 5A, 5B and 5C for the A, B and C phases respectively where the line voltage of 400 volts is sagged to 166 volts for a certain number of cycles.

Figure 6:
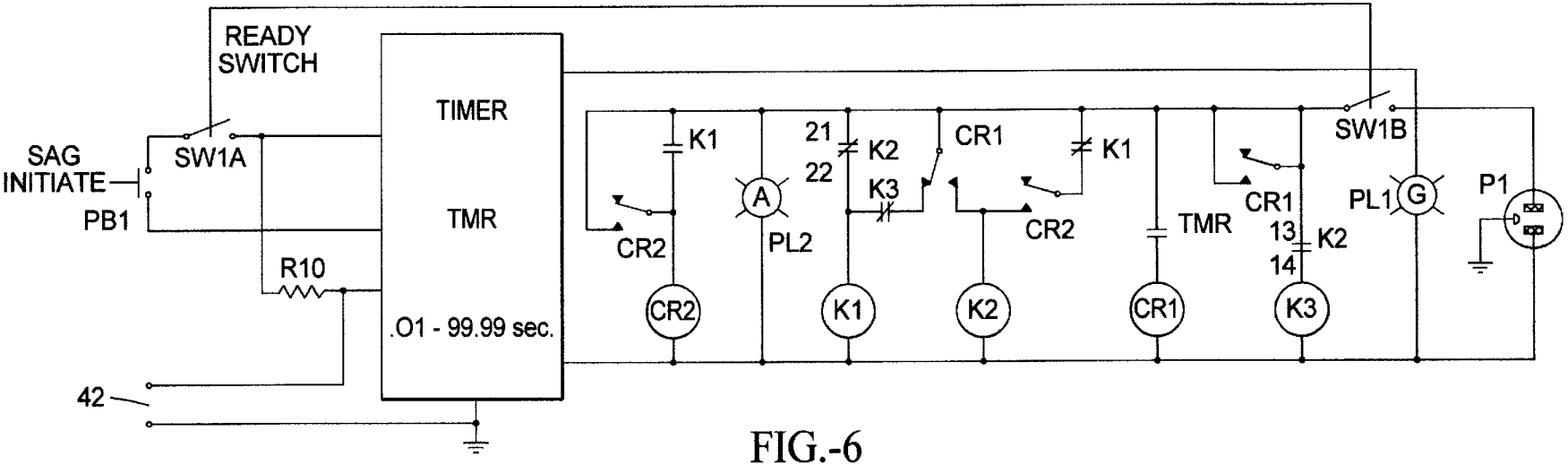
FIG. 6 is a schematic diagram of a sag generator control circuit.

Timing means for initiating a voltage sag for a predetermined time by actuating the K1, K2 and K3 switches is shown by the circuit of FIG. 6 and by the timing logic of FIGS. 7A–7D. The associated manual controls for operating the control circuit of FIG. 6 are illustrated in FIG. 8A. Timer unit 41 (TMR) is provided which is available from Red Lion Controls as the Libra Model L113 T2 (see FIG. 8 also). This timer is set from 0.01 to 99 seconds for controlling the duration of the sag. And the output of the timer at the pair of terminals 42 has a data record or trigger signal which is also shown at 42 on the output panel of FIG. 8. The panel also includes six instrumentation adjustment knobs R1–R6. Once the control power is supplied the green pilot light PL1 will illuminate and the control sequence is started by the operator closing the ready switch SW 1 (especially see the diagram of FIG. 6 and FIG. 7A). This enables the timer for accepting the operator's command to initiate a sag which is done by pressing the sag initiate button PBI. The pilot light PL2 is already illuminated when the ready switch is on. In FIG. 5 the control relays K1, K2, K3 and CR1 and CR2 are circled and control the similarly designated switches. These switches include the K1, K2, and K3 switches in FIG. 1 as well as the auxillary switches of FIG. 6.

Figures 7A, 7B, 7C, 7D:
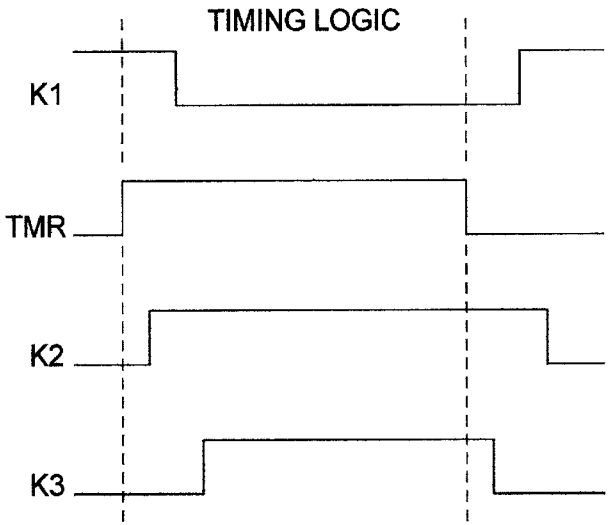
FIGS. 7A, B, C, and D are timing logic diagrams explaining the operation of FIG. 6.
Figure 8:
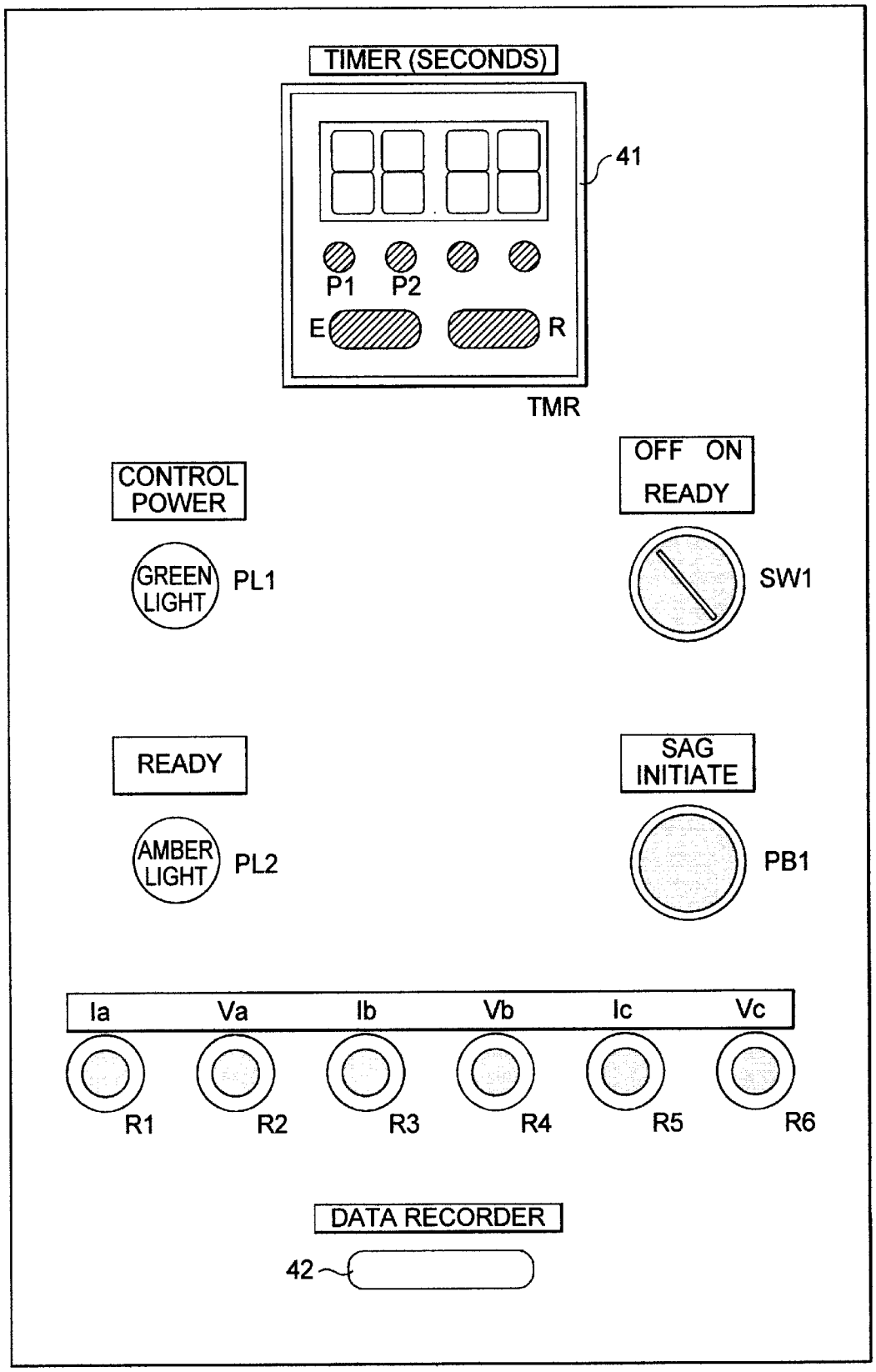
FIG. 8 is a plan view of a control panel for the controls for operating the control circuit of FIG. 6.

FIG. 7B illustrates the timer 41 (TMR) being actuated by the PB1 button—the sag initiate button (see FIG. 8). This energizes the control relay CR1 through the TMR switch which causes K2 to close as illustrated in FIG. 7C. In FIG. 6 the CR1 switch is moved to its other terminal. Thus the cascaded transformers are connected to the load but they are still short-circuited by the closed switch K1.

The closing of K2 causes K1 to be opened (FIG. 7A) (switch terminals 21 and 22 at K2 are closed to activate the K1 control relay). This thereby initiates a partial sag by inserting the auto-transformers series impedance between source and the load under test. Next, in FIG. 7D, relay contact CR1. terminals 6 and 8 enable the closing of K3 by way of auxiliary contacts 13 and 14 of K2. Once K3 closes connecting the transformers neutrals to the source neutral, the full effect of the sag is impressed.

When the timer reaches the end of the programmed sag time, contacts TMR open (FIG. 7B), de-energizing relay CR1 which in turn de-energizes K3. K3 and terminals 21 and 22 energizes K1 (FIG. 7A), which returns normal voltage to the load under test. Lastly the auxiliary contacts 21 and 22 of K2 open and de-energize K2 (FIG. 7C) returning the sequence to pre-sag conditions. Thus, as illustrated by the timing logic there is an overlap of the K1 and K2 switches which compensate for their opening and closing delay which ranges from 12 to 60 milliseconds. Thus the closed transition switching insures that the load is not totally disconnected from the power source while initiating sag. At the same time FIG. 7D shows that K3 remains open until the above switching is substantially completed to prevent a short circuit.

Finally referring to the control panel of FIG. 8, a data recorder may be plugged in at 42 and the various currents and voltages of three phases A, B and C may be tapped off to record voltages and currents illustrated in FIGS. 5A, 5B and 5C. Since the voltage taps of each auto-transformer are nonlinear the reverse connection provides a greater range of variations. Finally the fact that the auto-transformers are of a standard industrial type means that the mobile static or non-rotating unit of the present invention is eminently economical and at the same time will produce the necessary high power levels for modern industrial processes.

TABLE 1

Figure 4A:
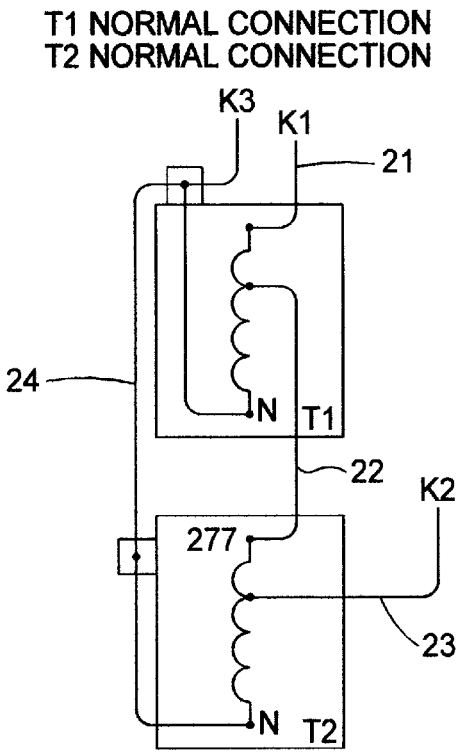
FIGS. 4A, 4B, 4C and 4D are simplified circuit schematics showing various connections made with the auto-transformers of FIG. 1.
Figure 4B:
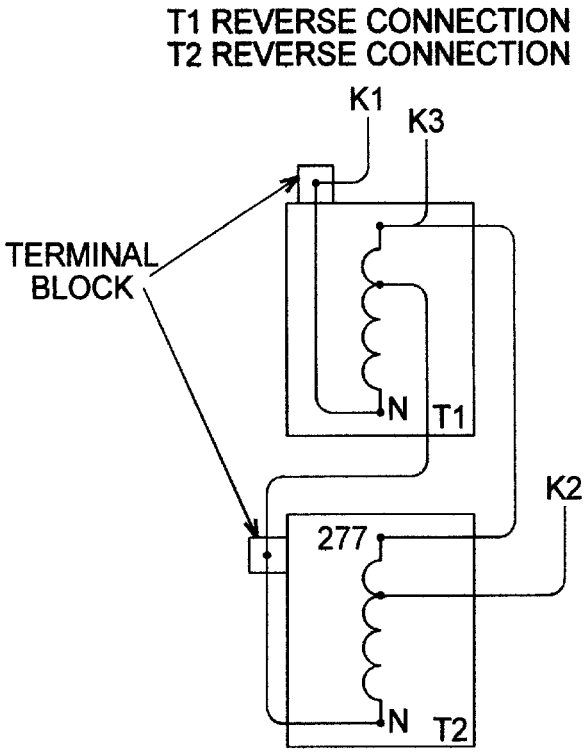
Figure 4C:
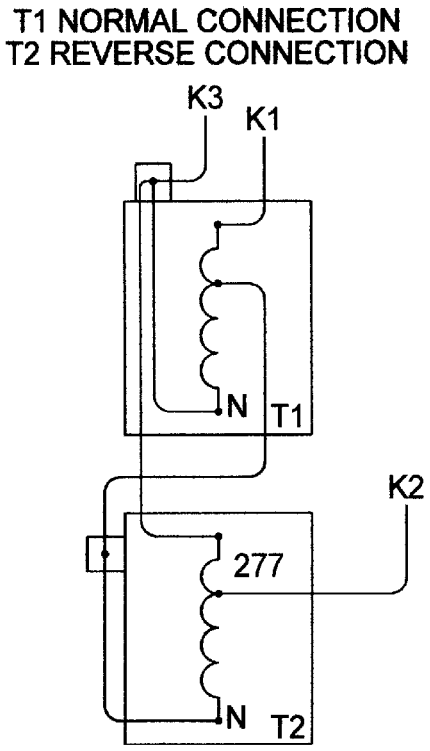
Figure 4D:
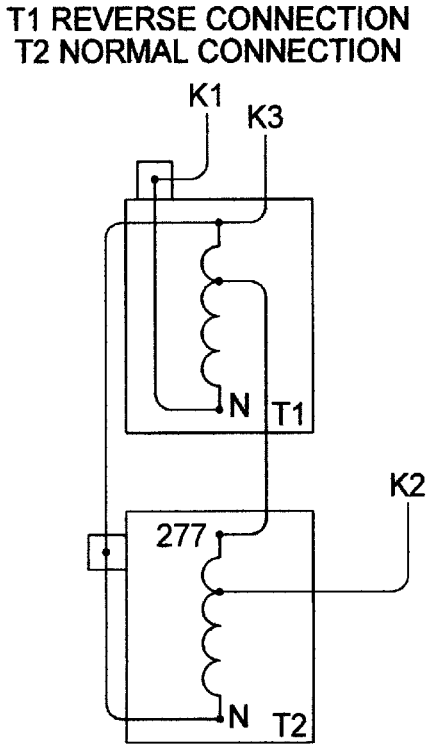

| Transformer connections shown in FIG. 4A. | | | T2 Neutral and 277 term. wiring reversed. | | | T2 Neutral and 277 term. wiring reversed. | | | T1 Neutral and 277 term. wiring reversed. | | | T1, T2 Neutral and 277 term. wiring reversed. | | |
|---|---|---|---|---|---|---|---|---|---|---|---|---|---|---|
| T1 | pu Volts | | T1 | pu Volts | | T1 | pu Volts | | T1 | pu Volts | | T1 | pu Volts | |
| 277 | 1.00 | | 277 | 1.00 | | 277 | 1.00 | | (N) | 1.00 | | (N) | 1.00 | |
| 249 | 0.90 | | 249 | 0.90 | | 249 | 0.90 | | (166) | \| | (166) | | | |
| | | | | | | | | | 0.40 | | 0.40 | | | |
| 222 | 0.80 | | 222 | 0.80 | | 222 | 0.80 | \| | (180) | 0.35 | \| | (180) | 0.35 | \| |
| 194 | 0.70 | | 194 | 0.70 | | 194 | 0.70 | \| | (194) | 0.30 | \| | (194) | 0.30 | \| |
| 180 | 0.65 | | 180 | 0.65 | | 180 | 0.65 | \| | (222) | 0.20 | \| | (222) | 0.20 | \| |
| 166 | 0.60 | \| | 166 | 0.60 | \| | 166 | 0.60 | \| | (249) | 0.10 | \| | (249) | 0.10 | \| |
| N | 0.00 | \| | N | 0.00 | \| | N | 0.00 | \| | (277) | 0.00 | \| | (277) | 0.00 | \| |
| | | \| | | | \| | | | \| | | | | | |
| T2 | | \| tie | T2 | | \| tie | T2 | | \| tie | T2 | | \| tie | T2 | | \| tie |
| (277) | 0.60 | \| | (N) | 0.60 | \| | (N) | 0.80 | \| | (277) | 0.40 | \| | (N) | 0.40 | \| |
| (249) | 0.54 | | (166) | 0.24 | | (166) | 0.32 | | (249) | 0.36 | | (166) | 0.16 | |
| (222) | 0.48 | | (180) | 0.21 | | (180) | 0.28 | | (222) | 0.32 | | (180) | 0.14 | |
| (194) | 0.42 | | (194) | 0.18 | | (194) | 0.24 | | (194) | 0.28 | | (194) | 0.12 | |
| (180) | 0.39 | | (222) | 0.12 | | (222) | 0.16 | | (180) | 0.26 | | (222) | 0.08 | |
| (166) | 0.36 | | (249) | 0.06 | | (249) | 0.08 | | (166) | 0.24 | | (249) | 0.04 | |
| N | 0.00 | | (277) | 0.00 | | (277) | 0.00 | | N | 0.00 | | (277) | 0.00 | |

What is claimed is:

1. A non-rotating portable voltage sag generator for connection between a utility type electric power source and an industrial load comprising;

a pair of cascaded auto-transformers for each phase, each having a plurality of voltage taps, one of the voltage taps of a first auto-transformer being connected to a second auto-transformer and including at least two bipolar switches, a first bipolar switch for connecting in a closed condition said power source directly to said load, and in an open condition diverting said power source through said first auto-transformer, a second bipolar switch in a closed connection connecting said second auto-transformer to said load and means for connecting one of said auto-transformers to a common or neutral;

timing means for initiating a voltage sag for a predetermined time interval by actuating said bipolar switches, said first bipolar switch being opened and said second bipolar switch being closed at substantially the same time to initiate said voltage sag, said timing means to terminate said voltage sag closing said first bipolar switch and opening said second bipolar switch at substantially the same time;

means for selecting the said one tap of said first transformer which is connected to said second transformer and also said tap of said second transformer which is connected to said load by said second bipolar switch, the product of the per unit of voltage of each auto-transformer being the final output voltage sag to said load.

2. A non-rotating portable voltage sag generator as in claim 1 where said timing means actuates said bipolar switches to provide closed transition switching of said switches by an overlap of said open and close.

3. A non-rotating portable voltage sag generator as in claim 1 where said power source is three phase and each cascaded auto-transformer includes a separate neutral whereby different voltage sags for each phase may be provided.

4. A non-rotating portable voltage sag generator as in claim 1 including means for recording voltage and current to said load.

5. A non-rotating portable voltage sag generator as in claim 1 where said voltage taps of each of said auto-transformers is non-linear whereby a reverse connection provides a greater number of variations.

6. A non-rotating portable sag generator as in claim 1 where said auto-transformers are of a standard indusrial type.

7. A non-rotating portable sag generator as in claim 1 where said means for connecting one of said auto-transformers to a common or neutral is a third switch, said timing means opening and closing said third switch with said second switch.

* * * * *